United States Patent [19]

Shine

[11] 3,994,462

[45] Nov. 30, 1976

[54] SHELF COUPLE AND HANGER ASSEMBLY

[76] Inventor: William P. Shine, 31 E. Dale Drive, Monroe, Conn. 06468

[22] Filed: June 24, 1974

[21] Appl. No.: 482,491

[52] U.S. Cl. ..... 248/248; 248/250; 248/343

[51] Int. Cl.[2] ..... A47G 29/02

[58] Field of Search ..... 248/235, 247, 248, 250, 248/317, 237, 300, 343; 108/92, 97; 211/90; 52/182, 191, 758 G

[56] References Cited

UNITED STATES PATENTS

| | | | |
|---|---|---|---|
| 1,412,406 | 4/1922 | Hodgson | 52/191 |
| 1,799,405 | 4/1931 | Bois | 52/191 |
| 1,878,084 | 9/1932 | Winkler | 248/343 |
| 2,461,157 | 2/1949 | Holden | 211/90 |
| 2,507,308 | 5/1950 | Kruger | 248/343 |
| 2,681,482 | 6/1954 | Heirich | 52/78 |
| 2,818,945 | 1/1958 | Holzer | 52/191 |
| 3,472,388 | 10/1969 | Blase | 248/300 |
| 3,803,790 | 4/1974 | Buck et al. | 52/78 |

*Primary Examiner*—Robert A. Hafer
*Attorney, Agent, or Firm*—Mattern, Ware, Davis & Stoltz

[57] ABSTRACT

A shelf couple assembly for mounting shelves on walls, wall studs, or rafters utilizes a unitary shelf-gripping couple having a protruding cantilever platform with raised rearward and forward portions and downwardly projecting barbs for fixedly supporting a shelf board between these raised portions and barbs. The assembly also incorporates a shelf trim channel that is snapped onto adjoining shelf boards to align them and to provide a visually unitary appearance. Furthermore, the assembly incorporates a rear shelf clip which may be driven into a wall-board, stud, or rafter for supporting the rearward portion of two adjoining shelf boards or for adding support to a section of shelf board that is heavily loaded. In addition, a cover is incorporated in the assembly that fits over the unitary shelf couple and thus conceals it while enhancing the overall appearance of the shelf couple assembly.

Furthermore, a rafter shelf hanger assembly for hanging shelves on roof rafters or inwardly sloping walls incorporates upper and lower horizontal platforms. The upper platform supports the rearward edge of an upper shelf board while the lower platform supports the forward edge of a second, lower, shelf board. The shelf trim covers and rear shelf clips of the wall mounted assembly are used with the shelf hanger to construct shelves of any desired length while providing an attractive appearance.

9 Claims, 20 Drawing Figures

FIG. 19
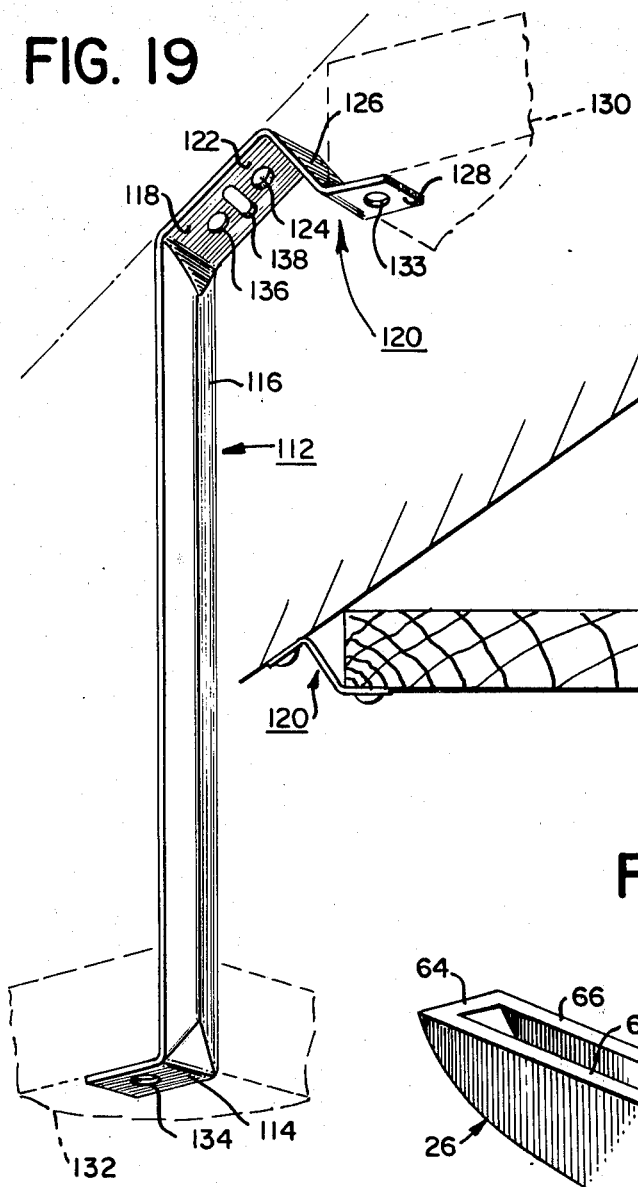
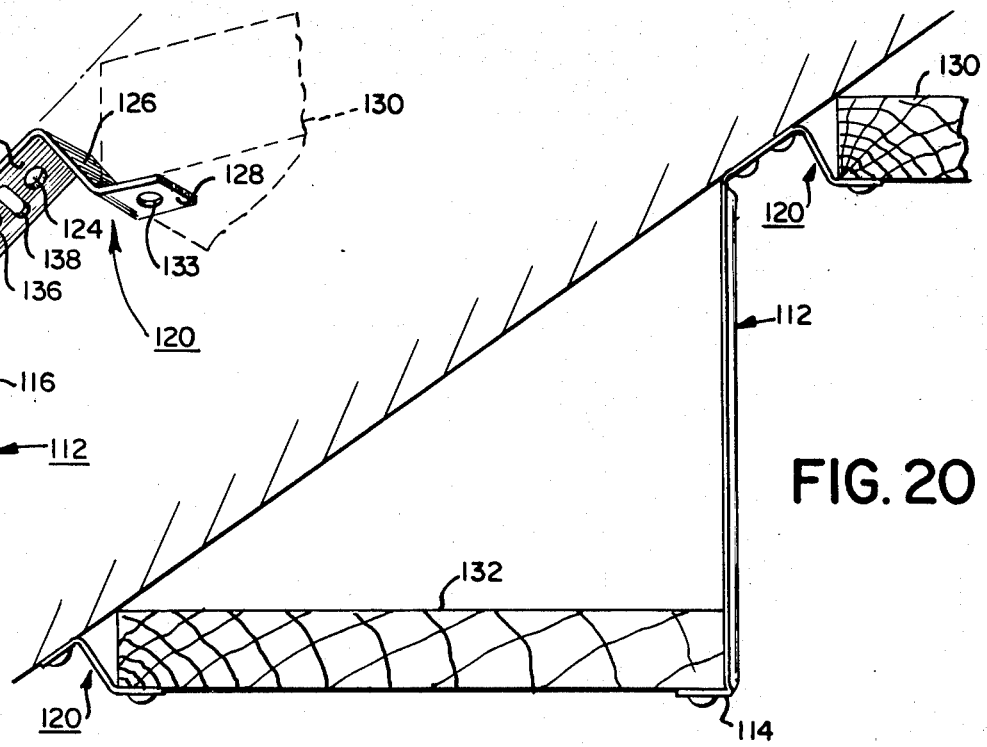
FIG. 20
FIG. 2
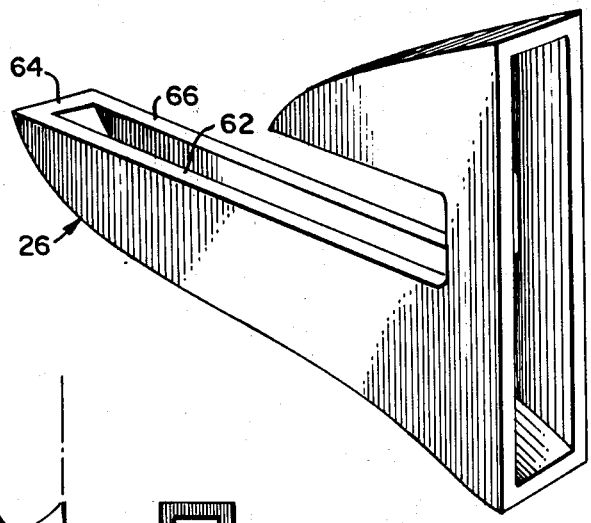
FIG. 3
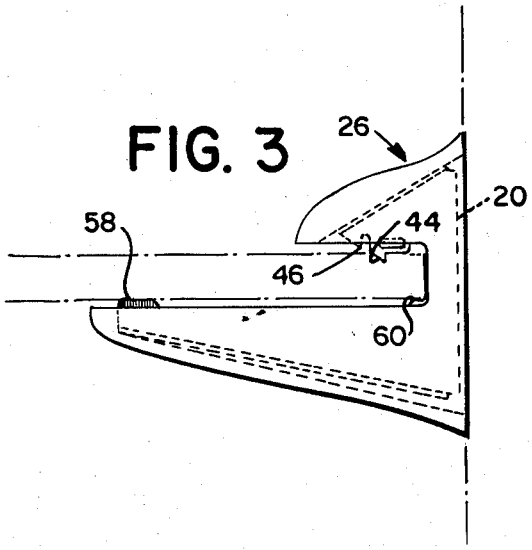
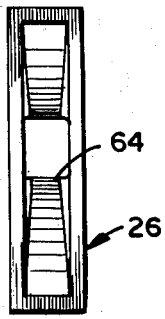
FIG. 17

SHELF COUPLE AND HANGER ASSEMBLY

BACKGROUND OF THE INVENTION

The present invention relates to an inexpensive and versatile shelf couple and shelf assembly for mounting shelves on walls, wall sutds, rafters and inwardly sloping walls.

The prior art shelf brackets do not teach the use of a self-embedding barb located on a shelf bracket for securing a section of shelf thereto. Thus U.S. Pat. No. 3,042,033 entitled "Multipurpose Supporting Bracket" teaches the use of a multi-positional supporting bracket that mounts to exposed building framing members and which is able to support a shelf placed on top of the platform of the bracket. However, the bracket does not use a self-embedding barb to maintain the shelf from moving but uses an aperture placed in an unturned lip on the forward portion of the platform for securing the shelf to the bracket. This technique requires that holes be placed within the shelf and also makes it rather difficult to move the shelf once secured to the bracket.

The present invention, by using a self-embedding barb, overcomes this difficulty and allows the shelf to be fixedly supported by the shelf-gripping couple once it is properly positioned. Furthermore, the shelf board may be easily moved after it is placed on a couple by simple manual depression of the shelf board which causes the embedded barb to dislodge from the groove formed in the board.

Although U.S. Pat. No. 883,323, entitled "Bracket" uses teeth on the bracket assembly to embed in a shelf board placed between the two inverted L-portions of the invention, it is necessary for one placing a board within this device to manually press the upper inverted L-shaped portion down on the board and then clamp the upper inverted L-shaped portion to the lower inverted L-shaped portion so as to maintain physical pressure upon the shelf board.

The same type of problem exists with U.S. Pat. No. 2,477,772 entitled "Shelf Bracket" where the upper inverted L-shaped portion has a depressed ridge for impinging upon a lower inclined portion of the upper surface of the lower inverted L-shaped portion of the device. Again, the upper inverted L-shaped portion first must be manually depressed upon the shelf board placed between the two inverted L-shaped portions and then clamped to the lower inverted L-shaped portion by means of a screw.

The present invention overcomes this awkwardness by fixedly supporting a shelf board on shelf-gripping couples. Furthermore, the present invention utilizes a shelf trim channel which is snapped onto the adjacent front edges of two adjoining shelf boards so as to align the boards and give structural rigidity across their adjoining edges. The use of this shelf trim channel with a rear shelf clip, also disclosed in the present invention, allows one to construct a shelf of any desired length with any number of shelf boards while maintaining structural rigidity throughout the entire length of the shelf. Furthermore, a pleasing appearance to the constructed shelving is obtained by obscuring the forward edge junction of adjoining shelf boards.

In addition, the present invention also discloses a cover that fits over the unitary shelf brackets and thus enhances the appearance of the couple assembly. The use of such a cover, along with the shelf trim channel to yield a pleasing appearance to an inexpensive shelf couple assembly is not disclosed or suggested in the prior art inventions.

Although the use of wall-embedding shelf clips is taught by several prior art patents, (see U.S. Pat. Nos. 1,098,227 entitled "Shelf Bracket"; 1,517,959 entitled "Shelf Bracket"; 2,849,123 entitled "Demountable Expanding Shelf"; and 2,261,078 entitled "Shelf and Mounting Therefor") these brackets do not contain an arcuate portion terminating with wall-embedding spurs. The arcuate portion allows the clip to be easily inserted into a wall for a predetermined depth. Therefore, the upwardly extending tab of the clip is maintained at a set distance from the wall and thus keeps the shelf boards with which it contacts at a prescribed distance from the wall. Thus, in the present invention, the rear shelf clip provides structural support and alignment where two adjoining shelf boards meet.

Furthermore, the present shelf hanger assembly discloses a rafter shelf hanger that has a rafter mounting plate that is mounted to an exposed roof rafter. This hanger further incorporates an upper horizontal platform that supports the rearward portion of a shelf board and a lower horizontal platform that supports the forward portion of a second, lower, shelf board. These hangers, when used in conjunction with the above mentioned shelf trim covers and rear shelf clips, allow one to construct a shelf of any length wherever inclined walls or rafters exist; such as in a typical home attic. This shelf hanger assembly is not taught or suggested by any of the prior art patents.

The different parts of this invention cooperate to form a unique shelf-mounting system, well adapted to accommodate shelves of standard 10 inch and 12 inch width, as well as many other different widths, from 4 inches up to 16 inches or more, if desired. The shelf-gripping couples of this invention actually bite into the mounted shelf, coupling it firmly to the wall and counteracting the tipping moment created by objects loaded on the shelf with an opposite moment or "couple" serving to anchor the shelf even more firmly to the wall. This biting, shelf-gripping action prevents inadvertent jarring or dislodging of mounted shelves, and permits the same basic couple to grip and support shelves of all standard thickness: the conventional pressed particle board and plywood thicknesses of ⅝-inch and ¾-inch, and the conventional wooden shelf board thickness standardized by the lumber industry at approximately 25/32-inches.

SUMMARY OF THE INVENTION

A shelf couple and hanger assembly for mounting shelves on walls, wall studs or rafters comprises five inexpensive components.

With respect to the shelf couple assembly, the invention comprises unitary shelf couples, shelf trim channels, rear shelf clips, and couple covers. The unitary shelf couples incorporate two self-embedding barbs for fixedly gripping a shelf board, and a cantilever platform for supporting the weight of a shelf board placed thereon. The couples preferably also incorporate a rearward raised cam portion in juxtaposed spaced relationship to the barbs. One of the barbs is spaced closer to the cantilever platform than the other barb and is used in conjunction with the cam portion to grip the rearward, upper section of a shelf board when it is positioned on the platform. If the shelf board has too great a thickness for the lower barb to be effectively used for properly affixing the board on the cantilever platform, this lower barb may be easily bent away, allowing the upper barb to self-embed in this thicker board.

Both barbs are maintained in their respective positions relative to the cantilever platform by means of a triangular overhang member from which they depend. This overhang member is connected to a spacing and mounting member which rigidly maintains the overhang member in juxtaposed spaced relationship to the upper edge of the cantilever platform. The spacing and mounting member in turn is integrally connected to the cantilever platform forming a rigid unitary shelf couple. The lower peripheral edge of the cantilever platform and the upper peripheral edge of the overhang member respectively incorporate flange portions for stiffening purposes. The mounting member, when adapted for mounting on walls or wall studs also incorporates a flange portion substantially perpendicular to the plane of the mounting member for strengthening as well as for mounting the bracket to a wall or stud by means of aperture holes in the flange. When the couple is adapted for mounting on exposed wall studs or rafters, the spacing member is of a substantially triangular configuration with aperture holes placed therein for mounting the bracket on the side portion of a wall stud.

The shelf trim channel and shelf clip operate in conjunction with each other so as to mechanically align and provide structural rigidity to two adjoining shelf boards. The shelf trim channel fits on the adjacent front edges of the two adjoining shelf boards and thereby maintains their alignment while providing a visual blending of the two adjoining boards.

The rear shelf clips support the rearward portions of two adjoining shelf boards and also maintains alignment of their adjoining edges. The shelf clips are embedded into the adjacent wall or stud by means of a pair of rearwardly extending spurs. In addition, the rear shelf clips may be placed along a portion of a shelf board where a unitary shelf couple may not be placed or is not desired to be placed so as to provide stabilization and load support to this portion of the shelf board.

The wall and wall stud shelf couple assembly also incorporates a unitary shelf couple cover which readily fits over the couple to provide a pleasing appearance to this portion of the shelf couple assembly. The couple cover may have a wood grain simulated exterior so as to blend in with the shelf boards providing an attractive overall shelf appearance.

The shelf hanger assembly utilizes a Z-shaped hanger with a slanted upper end portion that is mountable to an exposed roof rather or a wallboard-covered rafter. Depending therefrom is an upper shelf board platform that supports the rearward portion of a shelf board. The lower portion of the hanger comprises a lower shelf board platform that supports the forward edge of a next lower shelf. Thus, by the use of several of these hanger assemblies, a tiered array of shelves may be placed on any slanted wall or rafters. The shelf trim channel and rear shelf clips may be used in these hanger assemblies for aligning, stabilizing and supporting two adjoining shelf boards that are used to construct a unitary length of shelving.

In addition, all the shelf assembly components except the couple cover may be easily fabricated from sheet metal using standard state of the art blanking and forming techniques. The couple covers may be readily fabricated of plastic by injection molding processes.

OBJECTS OF THE INVENTION

It is therefore a principal object of the present invention to provide a shelf mounting assembly for easily mounting shelves on both vertical and slanting walls and wall support members.

A further object of the present invention is to provide a shelf couple assembly that is inexpensive to manufacture.

An additional object of the present invention is to provide a shelf couple assembly for mounting shelves on walls and wall studs that rigidly affixes the shelf boards on the shelf couple assembly while allowing easy removal of the shelf boards.

A still further object of the present invention is to provide a shelf couple assembly that is aesthetically attractive and which causes adjoining shelf boards to appear to be one continuous shelf board.

An additional object of the present invention is to provide a shelf hanger assembly for easily mounting shelves on roof rafters or inwardly sloping walls.

An additional object of the present invention is to provide a shelf hanger assembly that is inexpensive to fabricate.

A still further object of the present invention is to provide a shelf hanger assembly that is aesthetically attractive.

Other objects of the present invention will in part be obvious and will in part appear hereinafter.

The invention, accordingly, comprises an assembly of articles of manufacture possessing the features, properties, and relation of elements which will be exemplified as hereinafter described, and the scope of the invention will be indicated in the claims.

THE DRAWINGS

FIG. 2 is a perspective view of a unitary shelf couple cover according to the present invention.

FIG. 3 is a side view of the unitary shelf couple over showing the cover over a unitary shelf couple that is partially shown in phantom.

FIG. 17 is a rear view of the unitary shelf couple cover shown in FIG. 2.

FIG. 19 is a perspective view of a shelf hanger for mounting on rafters or inwardly sloping walls according to the present invention and showing two shelf boards in phantom.

FIG. 20 is a side view of a shelf hanger assembly for mounting on roof rafters inwardly sloping walls showing a rearward shelf board platform broken away from a portion of the uppermost shelf hanger as shown in FIG. 19.

DETAILED DESCRIPTION

Figure 1:
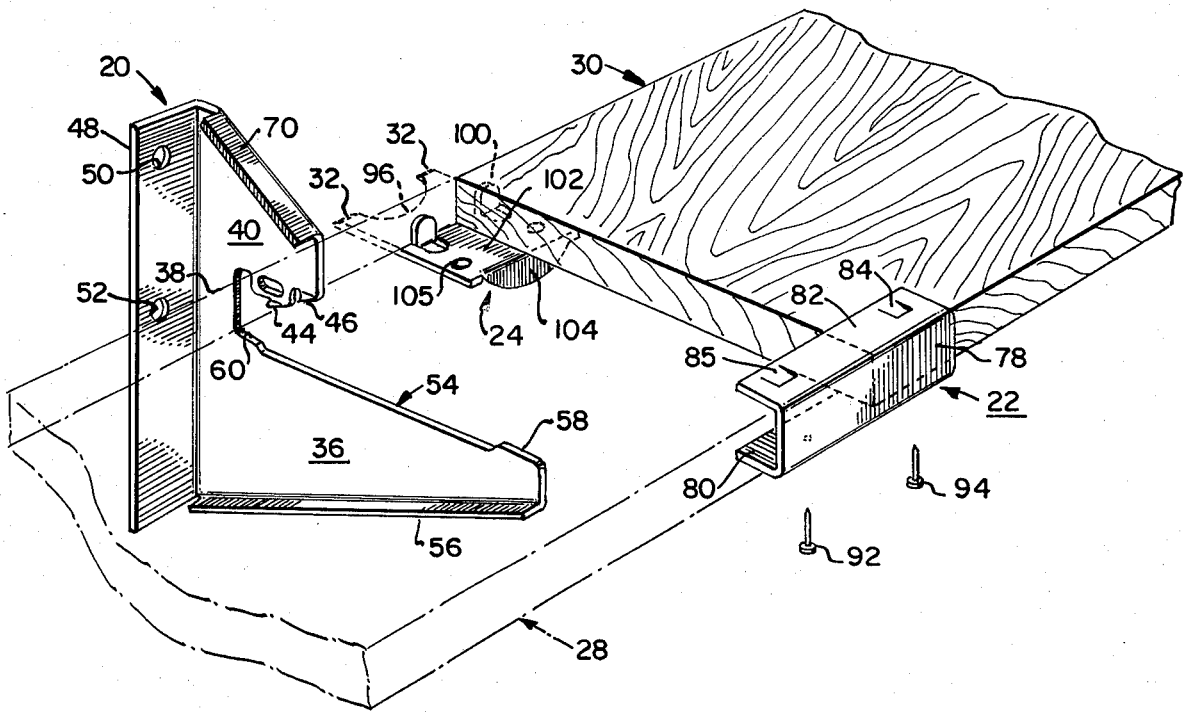
FIG. 1 is a perspective view of the unitary shelf couple assembly of the present invention showing two shelf boards one of which is in phantom.
Figure 10:
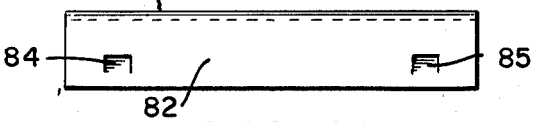
FIG. 10 is a top view of the shelf trim channel shown in FIG. 1, showing a portion of the channel in phantom.
Figure 11:
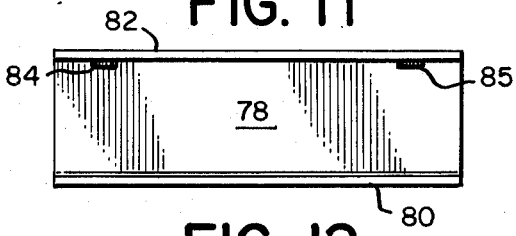
FIG. 11 is a rear view of the shelf trim channel shown in FIG. 1.
Figure 12:
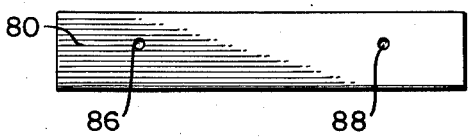
FIG. 12 is a bottom view of the shelf trim channel shown in FIG. 1.
Figure 13:
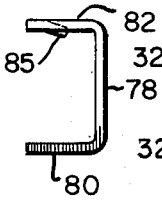
FIG. 13 is a side elevational view of the shelf trim channel shown in FIG. 1 showing a portion of the channel in phantom.
Figure 14:
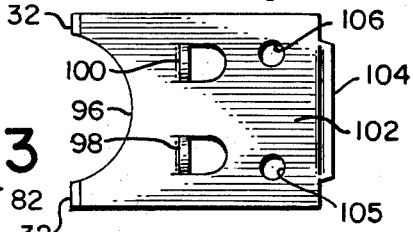
FIG. 14 is a top plan view of the rear shelf clip shown in FIG. 1.
Figure 15:
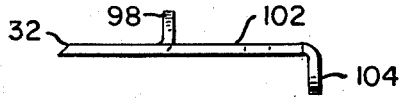
FIG. 15 is a side view of the rear shelf clip shown in FIG. 1.
Figure 16:
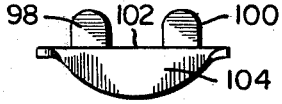
FIG. 16 is a front view of the rear shelf clip shown in FIG. 1.

As may best be seen in FIGS. 1, 2 and 3 the wall or wall stud shelf couple assembly of the present invention comprises a unitary shelf couple 20, a shelf trim channel 22, a rear shelf clip 24, and a unitary shelf couple cover 26. As seen in FIG. 3, the couple fits over the couple 20 so as to conceal from view all parts of the couple except for forward and rearward supporting and affixing portions of the couple; as will be discussed more fully later in this description. The couple cover is held in place on the couple bracket by the entrapping combination of the shelf board and wall.

As seen in FIG. 1, the shelf couple assembly allows for the construction of shelving with the shelf couple 20 supporting and affixing a shelf board 28 (shown in phantom), while the shelf trim channel 22 and the rear shelf clip 24 align and support two adjoining shelf boards 28 and 30. The rear shelf clip provides loading support to shelf boards by insertion of spurs 32 (in phantom) into an adjoining portion of a wall (not shown).

The unitary shelf couple 20 performs the majority of the load bearing for the shelf boards placed on the shelf couple assembly. The novel construction of this couple facilitates easy construction of a shelf system while fixedly gripping the shelf boards and thus preventing the boards from becoming dislodged in either an outward or sideward direction.

Figure 4:
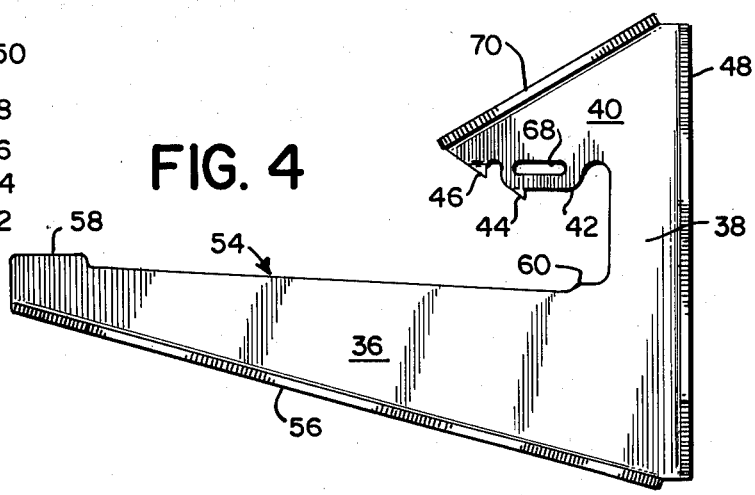
FIG. 4 is a side view of the unitary shelf couple shown in FIG. 1.
Figure 7:
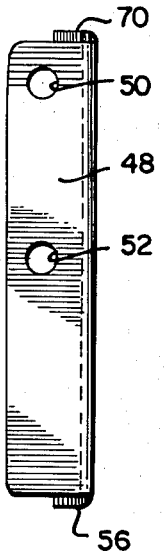
FIG. 7 is a rear view of the unitary shelf couple shown in FIG. 1, showing a portion of the couple in phantom.

More particularly, the wall mounting version of the couple 20 is best seen in FIGS. 1, 4, 5, 6, and 7. As seen in FIGS. 1 and 4, the couple incorporates three distinct regions, a cantilever platform 36, a wall affixing and spacing member 38, and a triangular overhang member 40 incorporating a barb tab 42 and barbs 44 and 46. The cantilever platform 36 supports the weight of the shelf board and items placed thereon. The spacing member 38 terminates at one portion thereof with cantilever platform 36 and at a second portion thereof with overhang member 40. Spacing member 38 thereby maintains the overhang member, the barb tab, and the barbs in a resiliently fixed, spaced relationship to the cantilever platform.

As best seen in FIGS. 4, 5, 6, and 7, spacing member 38 incorporates a rearward flange 48 that lies in a plane substantially perpendicular to the plane of the remainder of the spacing member. Flange 48 in turn incorporates mounting holes 50 and 52 wherein screws, nails or rivets are placed in order to affix the couple to a wall.

Figure 6:
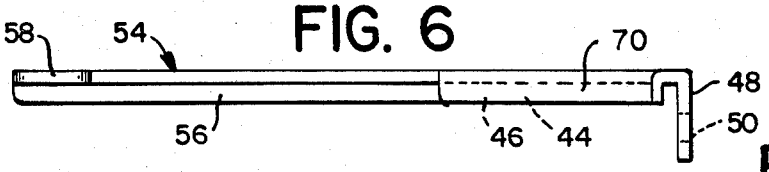
FIG. 6 is a top view of the unitary shelf couple shown in FIG. 1, showing a portion of the couple in phantom.
Figure 5:
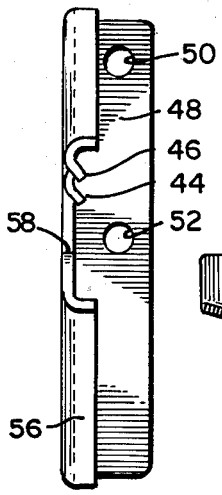
FIG. 5 is a front view of the unitary shelf couple shown in FIG. 1.

As best seen in FIGS. 4 and 6, cantilever platform 36 incorporates an upper edge generally shown as 54, a stiffening rib 56 and raised cam portions 58 and 60. Stiffening rib 56 provides structural rigidity to the remainder of the cantilever platform and thus improves the load bearing characteristics of the shelf couple. Forward raised cam 58 and rearward raised cam 60 facilitate the easy insertion of a shelf board within the couple. They also are the two regions of the cantilever platform that a shelf board contacts when properly mounted within the couple. As best seen in FIGS. 2 and 3, these raised cams protrude through the plane defined by edges 62, 64, and 66 of the couple cover.

The gripping action of the unitary shelf couple with an interfitting shelf board is best understood with reference to FIG. 4. Thus, when a board is placed on forward cam portion 58 and upper edge 54, and is moved toward spacing member 38, it continues to contact upper edge 54 until it reaches rearward cam portion 60. At this point, the rearward cam portion forces the shelf board upward and thereby impinges the upper surface of the shelf board against the downward projecting edge of barb 64. Due to the triangular configuration of barb 44, the shelf board may be further moved toward spacing member 38 until the rearward face of the board comes in physical contact with the forward edge of the spacing member. At this point, the shelf board is rigidly gripped and supported by the couple preventing the board's further movement in either a sideward or an outward direction. Any tipping moment created by objects placed on the shelf board is counteracted by the moment of the barb downward against the rearward face of the board. This counteracting moment serves to grip the shelf board more tightly to the couple bracket. Furthermore, since cam portion 58 is slightly higher than rearward cam portion 60, the mounted shelf board slopes slightly toward the mounting wall, thereby preventing objects placed on the shelf from rolling off.

If the shelf board is of a thickness greater than the space generated between the upper edge of rearward cam 60 and the lower edge of tab 42, the tab may be easily manually repositioned at 90° to the overhang member 40 by bending of the tab. Opening 68 allows for the easy manual flexure thereby allowing the tab to be bent on overhang member 40 by simple metal forming at the flexing regions. When the first barb is bent, the second barb 46 is exposed to engage a thicker shelf board and provided the same gripping action with the upper surface of this shelf board in a manner previously discussed with barb 44. Thus, it is readily seen that the unitary shelf couple of the present invention allows for more than one thickness of shelf board to be mounted thereon.

Furthermore, overhang member 40 incorporates a strengthening rib 70 to provide structural rigidity when a shelf board is placed on the couple and also when it is desired to bend tab 42 in order to reposition the tab and barb 44.

It should be noted that the rearward flange 48 and strengthening ribs 56 and 70 may be formed in a right-handed or left-handed configuration. Thus, the rearward flange and strengthening ribs are shown in a left-handed configuration in FIG. 1 and a right-handed configuration in FIGS. 4, 5, 6 and 7.

If it is later desired to remove a shelf board from a couple in which it is placed, this operation may be easily performed by manually depressing the rearward portion of the shelf board while pulling the shelf forward, thus causing the shelf to ride down the cam portion 60, and disengage the shelf from the barb 44 or 46 in a downward direction.

Figure 9:
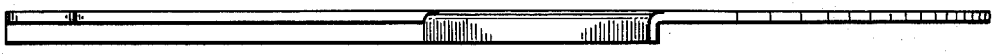
FIG. 9 is a top view of the unitary shelf couple shown in FIG. 8.
Figure 8:
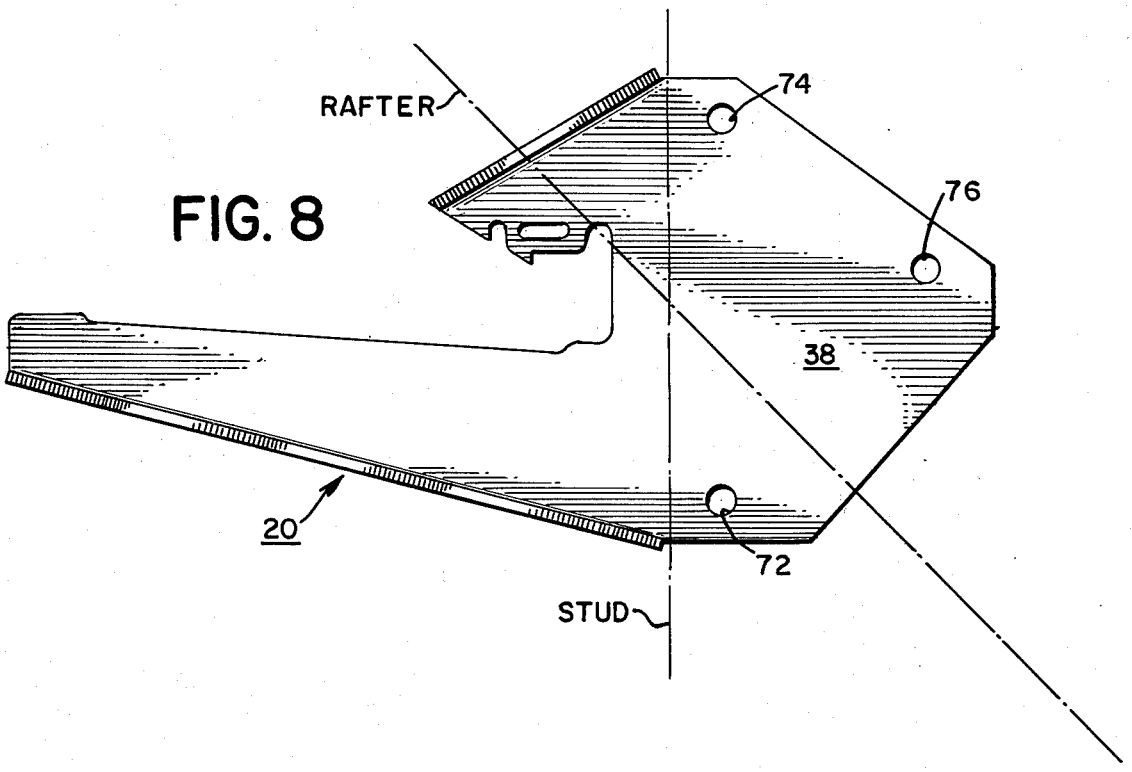
FIG. 8 is a side view of a second embodiment of a unitary shelf couple that is adapted for mounting on the side of a wall stud or roof rafter

As is best seen in FIGS. 8 and 9, the spacing and affixing member 38 may be constructed without flange 48 and with an increased area so as to allow couple 20 to be mounted on the side of a wall stud or rafter. In this configuration, spacing member 38 incorporates mounting holes 72, 74, and 76 for mounting the couple to the stud. Holes 74 and 76 are used to mount the couple on a roof rafter so that upper edge 54 of the cantilever platform is parallel to the floor. The remainder of this alternate embodiment of the couple 20 is identical to the wall mounted version previously discussed.

The construction and operation of shelf trim channel 22 may best be understood with reference to FIGS. 1, 10, 11, 12 and 13. As seen in FIG. 1, the shelf trim channel comprises a channel-shaped member with a forwardly facing web 78, a lower flange 80, and an upper flange 82. The channel attaches to the forward upper and lower faces of two adjoining shelf boards so as to provide alignment and structural rigidity to adjoining shelf boards. The shelf trim channel incorporates two detents 84 and 85 which project downwardly toward the upper surfaces of the adjoining shelf boards. Since these detents project downwardly and inwardly toward web 78, the channel may be easily pressed onto adjoining boards; but once on, removal thereof requires upper flange 82 to be lifted away from the adjoining shelf boards so as to allow detents 84 and 85 to disengage from these shelf boards. The channel 22 also includes mounting holes 86 and 88 located in the lower flange so as to insert nails or screws 92 and 94 through the respective openings and into the two adjoining shelf boards.

The shelf trim channel thus provides alignment of two adjoining shelf boards as well as structural rigidity for the forward portions of each board. The channels may also be used to provide alignment for the rearward portions of two adjoining shelf boards if further load bearing support is unnecessary. Since the shelf trim channel completely covers the forward edges of the two adjoining boards, the shelf couple assembly allows construction of a shelf of any given length with any number of shelf boards and still provides for visual continuity of these shelf boards. Indeed, if the shelf trim channels have a finish comparable to the shelf boards, the shelf boards will appear to be one continuous board.

The construction and operation of rear shelf clip 24 may best be understood with reference to FIGS. 1, 14, 15 and 16. The rear shelf clip is preferably unitary in construction as are couple 20 and shelf trim channel 22, and incorporates spurs 32 which may be embedded into an adjoining portion of a wall. The arcuate rearward edge 96 of the clip allows the easy insertion of the spurs into a wall until the hemispherical edge is completely within the wall. At this point, further insertion of the clip is more difficult and indeed, in the preferred embodiment of the present invention, unnecessary. The clip further comprises two upwardly projecting tabs 98 and 100 which form stop regions for a shelf board placed on forward plate 102 of the shelf clip. When the clip is fully embedded into a wall or stud, these tabs are preferably spaced from the wall or stud the same distance as the forward edge of spacing member 38. A downwardly depending arcuate wall 104 communicates with the forward plate 102 and provides structural rigidity and strengthening to the shelf clip 24 as well as allowing easy insertion of the clip into a wall.

As seen in FIG. 1, the shelf clip may be placed where two adjoining shelf boards meet so as to align the shelf boards and provide strengthening and load bearing support to these boards. Furthermore, the shelf clip may be used with a single shelf board in a region where further load bearing support is needed by the shelf board in order to prevent excessing sagging of the board. Screw holes 105 and 106 are placed within the forward plate 102 so as to prevent the shelf boards from shifting with respect to one another, as well as fastening the clip to the shelf board or boards.

The construction and function of the couple cover is best seen in FIGS. 2, 3, and 17. As seen in FIG. 2, the bracket cover is preferably of unitary construction with an outward shape substantially corresponding to that of the self-embedding barb couple. As seen in FIG. 17, the couple cover has a hollow interior recess with which the couple interfits. This hollow interior recess tapers inwardly so as to embrace the cantilever platform and overhang member of the shelf couple. As seen in FIG. 3, the forwardly raised cam 58, the rearwardly raised cam 60, and barbs 44 and 46 protrude through the generally U-shaped aperture of the couple cover since these are the portions of the couple which make contact with a shelf board placed thereon. The couple cover is preferably constructed from a plastic material so as to provide for inexpensive and simple fabrication thereof. The exterior surfaces of the cover may have a simulated wood grain as well as a wood color so as to correspond with the color and appearance of the shelf board.

Figure 18:
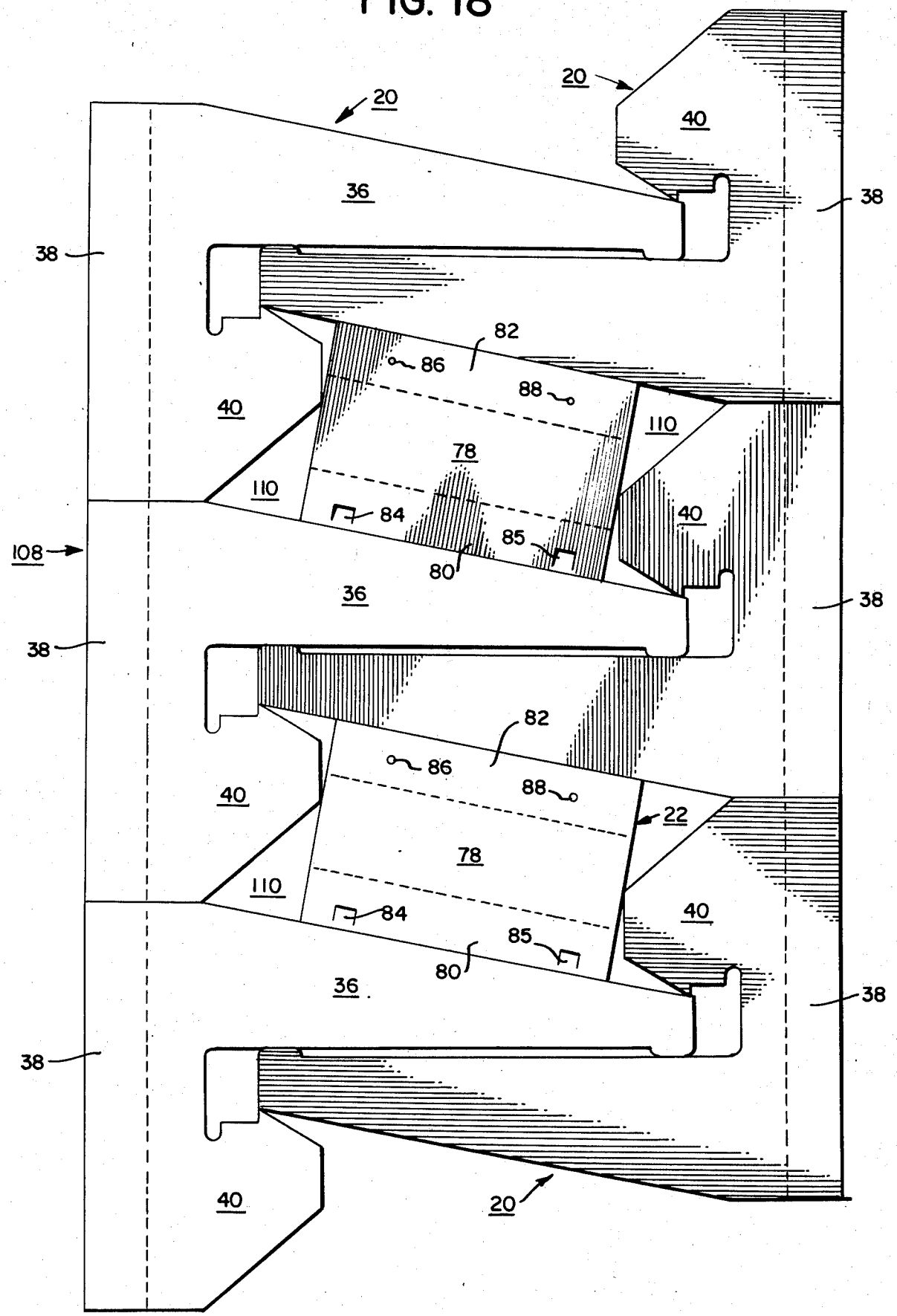
FIG. 18 is a top plan view of a portion of a sheet metal strip from which unitary shelf couples and shelf trim channels of the present invention may be fabricated.

As may best be seen in FIG. 18, the unitary shelf couple 20 and the shelf trim channel 22 may be inexpensively and easily manufactured from a coil of sheet metal 108. The various portions of the completed couple and the shelf trim channel are numbered for ease in understanding the blanking and forming operations. In a typical fabrication procedure, the sheet metal is first blanked by stamping and forming dies, whereby unused portions are stamped out of the sheet metal, such as triangular portion 110. Following this blanking operation, the various parts of both the couple and trim channel are formed by properly bending the blanked-out sheet metal. In the next operation, the parts are severed and separated from each other and the carrier coil of sheet metal.

As may best be seen in FIGS. 19 and 20, a shelf hanger for mounting on roof rafters or inwardly sloping walls has an elongated Z-shape and comprises a forward shelf board platform 114, a support brace 116, a mounting plate 118, and a rearward shelf board platform 120. The rearward shelf board platform 120 has a generally L-shape terminating with a forward region 122 of mounting plate 118. This forward region incorporates a mounting hole 24 for securing the platform to a rafter. The platform comprises a support brace 126 and a lower mounting plate 128. As seen in FIG. 19, an upper shelf board 130 (shown in phantom) rests on the lower mounting plate 128 and may be secured thereto via mounting hole 133. As also seen in FIG. 19 the angles support brace 126 makes with forward region 122 and lower mounting plate 128, may be adjusted so as to allow the rearward portion of the upper surface of shelf board 130 to be in physical contact with a portion of the inwardly sloping wall. In such a configuration, objects placed upon the upper surface of the shelf board are not able to slide off the rearward portion of the shelf board.

The forward portion of a lower shelf board 132 is mounted on the forward shelf board platform 114 of the hanger 112 and is secured thereto via a mounting hole 134 through which a wood screw or other fastener is placed.

The support brace 116 may consist of an elongated plate which preferably has an arched cross section for stiffening the support brace as well as yielding an attractive appearance. The rearward portion of mounting plate 118 terminates with the upper end of the support brace 116 and is secured to a portion of a rafter by means of a mounting hole 136 and accompanying screw or other fastener.

Thus, each hanger supports both a rearward portion of an upper shelf board and a forward portion of a lower shelf board. Tiers of shelf boards may therefore be hung on a set of rafters or inwardly sloping walls, thus providing inexpensive and attractive shelving. As is best seen in FIG. 20, the rearward portion of the lowermost shelf board is supported by a broken-off section of the uppermost shelf board. This platform is obtained by flexing the hanger at a flexure opening 138 whereby the rearward shelf board platform is broken away from the remainder of the hanger. Since the uppermost hanger used in a shelf hanger assembly need only support a lower shelf board, the removal of the forward shelf platform from this hanger is permissable and indeed advantageous. Thus, as shown in FIG. 20, if upper shelf board 130 did not exist, the forward shelf platform 120 of the hanger 112 could be removed by flexing along flexure opening 138 and subsequently mounted to a rafter so as to support the rearward portion of shelf board 132.

In the preferred embodiment of the shelf hanger assembly, adjoining shelf boards on the same level could be aligned and supported by use of shelf trim channels 22 and rear shelf clips 24 as previously described in the wall and wall stud shelf couple assembly. The rear shelf clips are preferably mounted to the top faces of the adjoining shelf boards so as to minimize flexing moments. It should also be noted that it is not necessary that any shelf board be of a particular length in order for the hung shelf to have an attractive appearance. Thus, for instance, if the hangers are evenly spaced at 16 or 24 inch intervals, a shelf board of 73 inches could be placed on the hangers so as to overhang on the two outermost brackets in an equal amount so as to yield an attractive appearance to the shelf hanger assembly. Thus, with the use of shelf trim channel and rear shelf clips, a continuous looking shelf board of any desired length may be hung on a set of rafters which is both pleasing in appearance as well as economical and easy to assemble.

It should also be noted that although the hanger is preferably blanked and formed from sheet metal, it may also be constructed from other materials. The hanger may also be configured wider member portions so as to secure the ends of two shelf boards.

Thus, what has been described is a new, unique, and inexpensive wall and rafter shelf couple and hanger assemblies which allow a person to rapidly construct attractive shelving on walls, wall studs, rafters, or inwardly sloping walls. Through the use of shelf trim channels and rear shelf clips, the length of any particular shelf is unlimited and any number of shelf boards may be aligned and secured to one another to form a visually continuous shelf. Furthermore, the present invention discloses a couple cover which fits over the unitary shelf couples of the invention aand therefore adds to the attractive appearance of the overall shelf couple assembly.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A shelf hanger for supporting substantially horizontal shelf boards and for mounting on roof rafters or inwardly sloping walls forming an angle Z with the horizontal comprising:

A. a rafter mounting plate having apertured mounting means thereon for mounting said hanger to said rafters or inwardly sloping wall;

B. a first shelf board platform depending downwardly from a first, front end of said mounting plate, having a substantially L-shaped configuration incorporating a plate member, extending forwardly away from the rafter mounting plate, dimensioned for supporting a rearward portion of a first of said shelf boards and a brace member for spacing said plate member from said mounting plate said plate member extending at an acute angle relative to the plane of said mounting plate;

C. an elongated support brace having a length greater than the brace member of said first shelf board platform, depending downwardly from said mounting plate at a second, rear end thereof, said brace having a length at least equal to tan Z times the width of a second of said shelf boards and forming an obtuse angle with said mounting plate; and D. a second shelf board platform, extending rearwardly away from the rafter mounting plate and substantially parallel to the plate member of the first shelf board platform, attached to the elongated lower end of said elongated support brace in a perpendicular direction thereto comprising a substantially flat plate for supporting the forward portion of said second shelf board.

2. A shelf hanger for supporting substantially horizontal shelf boards and for mounting on roof rafters or inwardly sloping walls forming an angle Z with the horizontal comprising:

A. a rafter mounting plate for mounting said hanger to said rafters or inwardly sloping wall comprising two mounting portions, each portion incorporating mounting means, and joined by a weakened section; whereby said mounting portions may be severed by flexure about said weakened section thereby producing separately mountable first and second shelf board platforms;

B. a first shelf board platform depending from a first, front end of said mounting plate, having a substantially L-shaped configuration and incorporating a plate member dimensioned for supporting a rearward portion of a first of said shelf boards and a brace member for spacing said plate member from said mounting plate;

C. an elongated support brace having a length greater than the brace member of said first shelf board platform, depending downwardly from said mounting plate at a second, rear end thereof, said brace having a length at least equal to tan Z times the width of a second of said shelf boards; and D. a second rearwardly extending shelf board platform attached to the elongated lower end of said elongated support brace in a perpendicular direction thereto comprising a substantially flat plate for supporting the forward portion of said second shelf board.

3. A shelf hanger assembly for supporting shelf boards and for mounting on roof rafters of inwardly sloping walls forming an angle Z with the horizontal comprising:

A. a first shelf board platform incorporating:

1. a first rafter mounting plate having apertured mounting means theron for mounting said platform to said rafters or inwardly sloping wall;
2. a first shelf board support member depending downwardly from said mounting plate, having a substantially L-shaped configuration incorporating a plate member extending forwardly away from the first rafter mounting plate, dimensioned for supporting the rearward portion of one of said shelf boards and a brace member for spacing said plate member from said mounting plate said plate member extending at an acute angle relative to the plane of said mounting plate; and B. a second shelf board platform comprising:

1. a second rafter mounting plate having apertured mounting means thereon for mounting said platform to a rafter or an inwardly sloping wall;
2. an elongated support brace having a length greater than the brace member of said first shelf board support member, depending downwardly from said mounting plate and forming an obtuse angle with said second mounting plate and having a length at least equal to tan Z times the width of said shelf board; and
3. a rearwardly extending shelf board support plate, extending rearwardly away from the second rafter mounting plate and substantially parallel to the plate member of the first shelf board platform, attached to the elongated lower end of said support brace in a perpendicular direction thereto for supporting the forward portion of said first shelf board.

4. A shelf hanger assembly as defined in claim 3, wherein said first shelf board platform and said second half board platform are severably attached at an edge of each rafter mounting plate.

5. A shelf board and hanger assembly for mounting on roof rafters or inwardly sloping walls forming an angle Z with the horizontal comprising:

A. N shelf boards, N being an integer greater than one, the Nth shelf board designated as the uppermost to the first shelf board designated as the lowermost;

B. at least 2N−2 of a first type of shelf hanger each comprising:

1. a rafter mounting plate for mounting said hanger to said rafters or inwardly sloping walls;
2. a first shelf board platform depending downwardly from a first, front end of said mounting plate, having a substantially L-shaped configuration and incorporating a plate member supporting the rearward portion of one of the second to the Nth shelf boards and a brace member spacing said plate member from said mounting plate;
3. an elongated support brace depending downwardly from said mounting plate at a second, rear end thereof, said brace having a length at least equal to tan Z times the width of a second of said shelf boards; and
4. a second rearwardly extending shelf board platform attached to the elongated lower end of said elongated support brace in a perpendicular direction thereto comprising a substantially flat plate supporting the forward portion of one of the first to (N−1)st shelf boards;

C. at least two of a second type of shelf board platform for supporting the forward edge of the Nth, uppermost shelf board, each comprising:

1. a rafter mounting plate for mounting said platform to said rafters or inwardly sloping walls;
2. an elongated support brace depending from said mounting plate and having a length at least equal to tan Z times the width of the uppermost shelf board; and
3. a rearwardly extending shelf board support plate attached to the elongated lower end of said support brace and in a perpendicular direction thereto supporting the forward edge of said uppermost shelf board; and D. at least two of a third type of shelf board platform for supporting the rearward portion of the first, lowermost shelf board, each comprising:

1. a rafter mounting plate for mounting said platform to said rafters or inwardly sloping walls;
2. a shelf board support member depending from said mounting plate, having a substantially L-shaped configuration and incorporating a plate member supporting the rearward portion of the lowermost shelf board and a brace member for spacing said plate member from said mounting plate;

whereby said shelf boards are hung from roof rafters or an inwardly sloping wall in a tiered configuration.

6. A shelf hanger for supporting shelf boards and for mounting on roof rafters or inwardly sloping walls, comprising:

A. a rafter mounting plate having apertured mounting means thereon for mounting said hanger to said rafters or inwardly sloping walls;

B. a first forwardly extending shelf board platform depending downwardly from a first front end of said mounting plate having a substantially L-shaped configuration and incorporating a plate member, extending forwardly away from the rafter mounting plate, dimensioned for supporting a rearward portion of a first of said shelf boards and a brace member for spacing said plate member from said mounting plate said plate member extending at an acute angle relative to the plane of said mounting plate;

C. an elongated support brace depending from said mounting plate at a second, rear end therof and forming an obtuse angle with said mounting plate; and D. a second rearwardly extending shelf board platform, extending rearwardly away from the rafter mounting plate and perpendicularly attached to the elongated lower end of said support brace in a parallel configuration with the plate member of said first shelf board platform and in a non-parallel configuration with said mounting plate having a substantially flat plate for supporting the forward portion of said second shelf board.

7. A shelf hanger for supporting shelf boards and for mounting on roof rafters or inwardly sloping walls, comprising:

A. a rafter mounting plate for mounting said hanger to said rafters or inwardly sloping walls comprising two mounting portions each portion incorporating mounting means, and joined by a weakened section; whereby said mounting portions may be severed by flexure about said weakened section thereby producing a separately mountable first and second shelf board platform;

B. a first forwardly extending shelf board platform depending from a first front end of said mounting plate having a substantially L-shaped configuration and incorporating a plate member dimensioned for supporting a rearward portion of a first of said shelf boards and a brace member for spacing said plate member from said mounting plate in a non-parallel configuration to said mounting plate;

C. an elongated support brace depending from said mounting plate at a second, rear end thereof; and D. a second rearwardly extending shelf board platform attached to the elongated lower end of said support brace in a parallel configuration with the plate member of said first shelf board platform and in a non-parallel configuration with said mounting plate having a substantially flat plate for supporting the forward portion of said second shelf board.

8. A shelf hanger assembly for supporting shelf boards and for mounting on roof rafters or inwardly sloping walls comprising:

A. a first shelf board platform incorporating:

1. a first rafter mounting plate having apertured mounting means thereon for mounting said platform to said rafters or inwardly sloping walls;
2. a first forwardly extending shelf board platform member downwardly depending from said mounting plate having a substantially L-shaped configuration incorporating a plate member, said plate member extending at an acute relative to the plane of said first mounting plate and extending forwardly away from the first rafter mounting plate, dimensioned for supporting a rearward portion of one of said shelf boards and a brace member for spacing said plate member from said mounting plate in a non-parallel configuration to said first mounting plate; and B. a second shelf board platform comprising:

1. a second rafter mounting plate having apertured mounting means thereon for mounting said platform to a rafter or inwardly sloping wall;
2. an elongated brace depending downwardly from said second mounting plate and forming an obtuse angle with said second mounting plate; and
3. a second rearwardly extending shelf board platform member extending rearwardly away from the rafter mounting plate, attached to the elongated lower end of said support brace in a perpendicular direction thereto for supporting the forward portion of said shelf board.

9. A shelf hanger assembly as defined in claim 8, wherein said first shelf board platform and said second shelf board platform are severably attached at an edge of the first and second rafter mounting plates.

* * * * *

UNITED STATES PATENT AND TRADEMARK OFFICE

CERTIFICATE OF CORRECTION

PATENT NO. : 3,994,462

DATED : Nov. 30, 1976

INVENTOR(S) : William P. Shine

It is certified that error appears in the above-identified patent and that said Letters Patent are hereby corrected as shown below:

Column 1, Line 7, "sutds" should be --studs--
Column 3, Line 26, insert --rear-- after "and".
Column 3, Line 52, "rather" should be --rafter--.
Column 4, Line 42, "over" should be --cover--.
Column 4, Line 55, insert --.-- after "rafter".
Column 5, Line 16, insert --or-- after "rafters".
Column 5, Line 26, insert --cover-- after "couple".
Column 6, Line 49, "provided" should be --provide--.
Column 8, Line 11, "excessing" should be --excessive--.
Column 8, Line 59, "24" should be --124--.
Column 9, Line 31, "permissable" should be --permissible--.
Column 11, Line 23, "theron" should be --thereon--.
Column 11, Line 56, "half" should be --shelf--.
Column 12, Line 66, "therof" should be --thereof--.
Column 14, Line 12, insert --angle-- after "acute".

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*